US011815062B2

(12) United States Patent
Tyaglin

(10) Patent No.: US 11,815,062 B2
(45) Date of Patent: Nov. 14, 2023

(54) ENERGY GENERATOR

(71) Applicant: Denis Valentinovich Tyaglin, Novosibirsk (RU)

(72) Inventor: Denis Valentinovich Tyaglin, Novosibirsk (RU)

( * ) Notice: Subject to any disclaimer, the term of this patent is extended or adjusted under 35 U.S.C. 154(b) by 113 days.

(21) Appl. No.: 17/629,205

(22) PCT Filed: Aug. 13, 2020

(86) PCT No.: PCT/RU2020/050186
§ 371 (c)(1),
(2) Date: Jan. 21, 2022

(87) PCT Pub. No.: WO2021/040569
PCT Pub. Date: Mar. 4, 2021

(65) Prior Publication Data

US 2022/0235734 A1 Jul. 28, 2022

(30) Foreign Application Priority Data

Aug. 26, 2019 (RU) ..... RU2019126771

(51) Int. Cl.
*F03B 17/02* (2006.01)
*F03B 17/04* (2006.01)

(52) U.S. Cl.
CPC ..... *F03B 17/02* (2013.01); *F03B 17/04* (2013.01)

(58) Field of Classification Search
CPC ..... F03B 17/02; F03B 17/025; F03B 17/04; F05B 2210/401
See application file for complete search history.

(56) References Cited

U.S. PATENT DOCUMENTS 7,656,051 B2 2/2010 Perin
8,024,927 B1 * 9/2011 Azizi ..... F03B 17/02 290/1 R

FOREIGN PATENT DOCUMENTS

DE 202006009953 U1 8/2006
DE 102011018425 A1 * 11/2012 ..... F03B 17/025
(Continued)

OTHER PUBLICATIONS

Machine translation of DE-102011018425-A1, accessed Jun. 29, 2023. (Year: 2023).*

*Primary Examiner* — Jonathan R Matthias
(74) *Attorney, Agent, or Firm* — Muncy, Geissler, Olds & Lowe, P.C.

(57) ABSTRACT

The technical solution relates to the field of power engineering, specifically, to hydroelectric power plants. The power generator contains a body in the form of a vertical vessel filled with liquid, in which a platform with an opening in the upper part, the inner part of which has the shape of a bell, is placed, as well as a means to impart positive buoyancy to the platform by accumulating air, located on the lower side of the platform, a channel connected to the opening in the upper part of the platform, windows connected to the channel, valves installed between the channel and the means for imparting positive buoyancy to the platform; a turbine installed on the platform, designed so as to be able to rotate under the action of liquid flowing through the channel, and equipped with means for transmitting the generated electric power; means for preventing the platform from rotating. According to the claimed technical solution, the turbine is also designed so as to be able to rotate under the action of air released through the valves from the means for imparting positive buoyancy to the platform. The generator may contain additional valves installed in the windows connected to the channel. The platform may have a
(Continued)

cross-sectional shape that follows the cross-sectional shape of the inner surface of the body. The means for preventing the platform from rotating can be embodied in the form of a protrusion on the platform, located in the corresponding recess on the inner surface of the body. The technical result of the claimed technical solution is manifested in an increased performance efficiency of the power generator.

4 Claims, 1 Drawing Sheet

(56) References Cited

FOREIGN PATENT DOCUMENTS

| | | | | |
|---|---|---|---|---|
| GB | 2515541 | A | | 12/2014 |
| KR | 20110107561 | A | * | 10/2011 |
| RU | 2170364 | C2 | | 7/2007 |

* cited by examiner

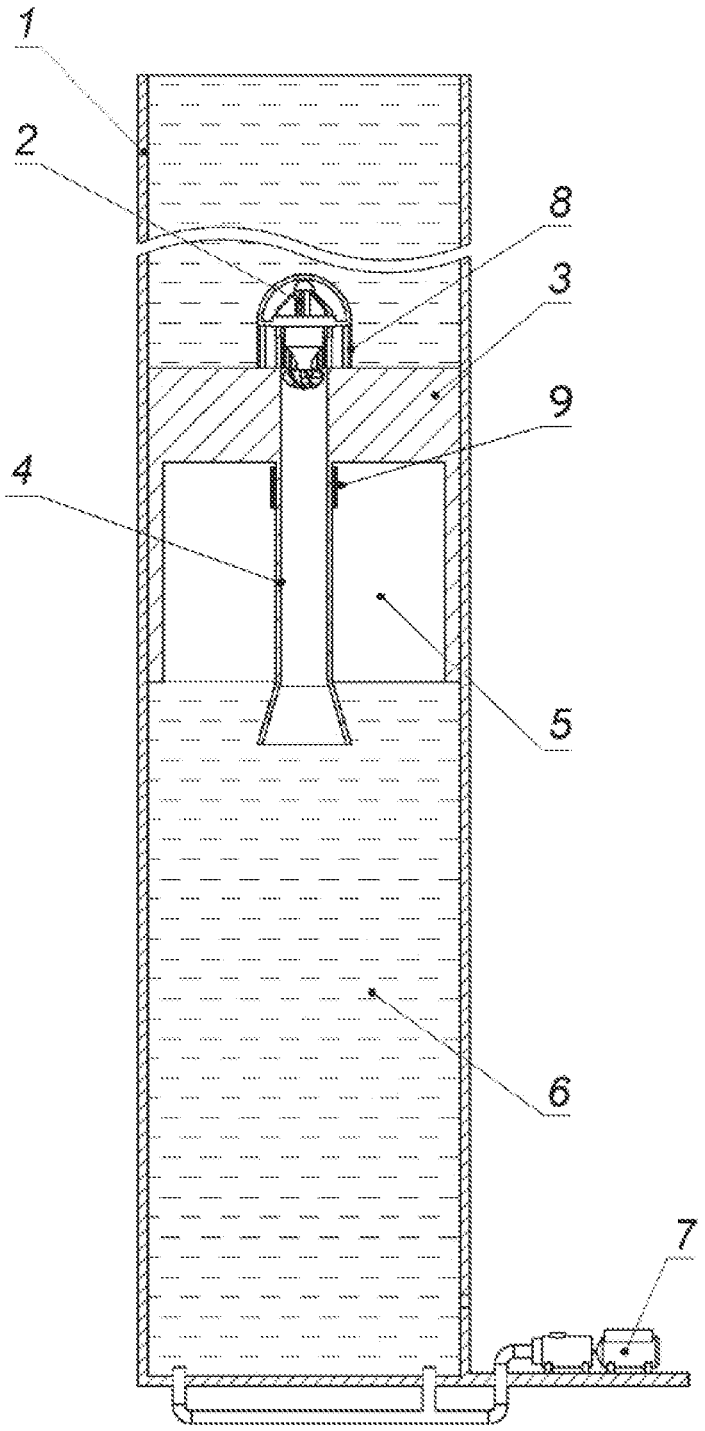
1
2
8
3
9
4
5
6
7

ENERGY GENERATOR

FIELD OF INVENTION

The claimed technical solution relates to the field of power engineering, specifically, to hydroelectric power plants, and can be used to produce electric power by alternately using gravity and buoyancy principle.

BACKGROUND OF THE INVENTION

A floating turbine driven up and down in a tower filled with water is known from the prior art, according to patent application DE202007 009953 Auf-and Abtriebs-Turbinen-schwimmer im Wasserturm (IPC F03B17/02, published on 24 Aug. 2006). The known solution is a cylindrical tower filled with water, into which a platform with a turbine installed thereon is placed. The platform is equipped with means for imparting positive or negative buoyancy to it in the form of cavities filled alternately with air or water. The turbine is designed so as to be able to rotate under the action of water, when the platform moves upwards.

The floating turbine according to patent GB2515541 FLOATING TURBINE (IPC F03B17/02; F03B17/04, published on 31 Dec. 2014) was chosen as the closest analogue. The known solution is a turbine installed on a platform placed in water and moving up and down along a guide, for which a pipe-like object can be used. The platform has negative buoyancy in order to facilitate its lowering, but is additionally equipped with adjustable means to give it positive buoyancy, in particular, in the form of ballast tanks or compartments; when positive buoyancy is achieved, the turbine rises up. With the alternating movement of the platform under the action of gravity and buoyancy principle, the movement of water through the turbine blades rotates them, which, in turn, makes the generator produce electric power.

In the known solution, when the platform reaches the upper position, in order to impart negative buoyancy to it, the air from the ballast tanks or compartments is discharged into the atmosphere and does not participate in the generation of electricity, which reduces the performance efficiency of the device.

DISCLOSURE OF THE INVENTION

In the claimed technical solution, it is proposed to use air from the means to impart positive buoyancy to the platform for additional turbine rotation and electric power generation. The technical result consists in increasing the performance efficiency of the generator.

The technical result is achieved in that in the power generator containing a body in the form of a vertical vessel filled with liquid, in which a platform with an opening in the upper part, the inner part of which has the shape of a bell, is placed, as well as a means to impart positive buoyancy to the platform by accumulating air, located on the lower side of the platform, a channel connected to the opening in the upper part of the platform, windows connected to the channel, valves installed between the channel and the means for imparting positive buoyancy to the platform; a turbine installed on the platform, designed so as to be able to rotate under the action of liquid flowing through the channel, and equipped with means for transmitting the generated electric power; means for preventing the platform from rotating, according to the claimed solution, the turbine is also designed so as to be able to rotate under the action of air released through the valves from the means for imparting positive buoyancy to the platform. The generator may contain additional valves installed in the windows connected to the channel. The platform has a cross-sectional shape that follows the cross-sectional shape of the inner surface of the body. The means for preventing the platform from rotating can be embodied in the form of a protrusion on the platform, located in the corresponding recess on the inner surface of the body.

Due to the fact that the turbine is rotatable both under the action of liquid and under the action of air released through the valves from the means for imparting positive buoyancy to the platform, the performance efficiency of the generator is increased, since when the turbine rotates under the action of air, additional electric power is generated.

In order to prevent the platform from rotating during its up and down movement, the platform is equipped with a means for preventing the platform from rotating, which can be designed in various versions known from the prior art. Preferably, such means should be made in the form of a protrusion on the platform, located in the corresponding recess on the inner surface of the body, for example, in the form of a vertical rail situated on the inner surface of the body and the corresponding protrusion made on the platform and located in the said rail.

BRIEF DESCRIPTION OF DRAWINGS

The claimed solution is illustrated with a FIGURE, which shows one of its possible embodiments.

In the FIGURE, the numbers indicate the following: 1—body, 2—turbine, 3—platform, 4—channel, 5—means for imparting positive buoyancy to the platform, 6—liquid, 7—compressor for air supply. 8—windows, 9—valves.

Further, the design of the generator and its operation are explained with reference to the FIGURE. The generator body (1) is designed in any known way, the shapes and sizes are selected based on the specific needs and the required performance. It is preferable to design the body (1) in such a shape that it allows several generators to be installed side by side, for example, in the form of honeycombs.

The turbine (2) is installed in the opening of the platform (3) and is designed so as to be able to rotate both under the action of liquid (6) flowing through the channel (4) and windows (8) from one part of the body to another when the platform (3) moves up and down and under the action of air, when the platform (3) is in the upper position and from the means (5) for imparting buoyancy to the platform, through the valves (9), air is released, which also leads to the rotation of the turbine (2).

The platform (3) has the shape of a bell with an opening in the upper part, in which the turbine (2) is located. The shape of a bell is understood to mean a shape that is characterized by the presence of a hollow dome, the edges of which are directed downward. The dome can have a variety of shapes, including cylindrical and conical ones. The platform (3) has a cross-sectional shape that follows the cross-sectional shape of the inner surface of the body. To eliminate the rotation of the platform (3) in the process of its movement up and down, the platform (3) is equipped with a means to prevent the rotation of the platform (not shown in the FIGURE). A channel (4) is connected to the opening, preferably in such a way that its upper end is connected to the windows (8), and its lower end is below the air level in the means (5) for imparting buoyancy to the platform. Also connected to the channel (4) are valves (9) installed between the channel (4) and the means (5) for imparting positive buoyancy to the platform, and serving to release air therefrom. On the lower side of the platform (3), there is the means (5) for imparting positive buoyancy to the platform by accumulating air, for example, in the form of a reservoir bounded by the walls of the platform (3). The platform (3) has such a weight that, in the absence of air in the means (5), it has negative buoyancy and falls down under the action of gravity.

As a liquid (6), both water and any other liquid can be used, the density of which allows it to flow from one part of the body to another, when the platform (3) moves up and down, and to rotate the turbine (2).

For pumping air into the means (5) for imparting buoyancy to the platform (3), in particular, a compressor (7) can be used.

BEST MODE FOR CARRYING OUT THE INVENTION

Further, the implementation of the claimed technical solution is disclosed. A generator body (1) is made by any known method. The body is filled with liquid (6), and the platform (3) is placed in it. The platform (3) is designed in the form of a bell with an opening in the upper part, to which a channel (4) with windows (8) is connected. A turbine (2) is placed in the opening, and a means (5) is provided on the lower side of the platform (3) to impart positive buoyancy to the platform by accumulating air, for example, in the form of a reservoir bounded by the walls of the platform (3). The weight of the platform (3) is selected in such a way that, in the absence of air in the means (5) for imparting buoyancy to the platform, it has negative buoyancy and falls down under the action of gravity. When the platform (3) is in the lower part of the body (1), air is pumped into the means (5) for imparting buoyancy to the platform, situated in the lower part of the platform (3), using the compressor (7). With the accumulation of a sufficient amount of air in the means (5), the platform (3) acquires positive buoyancy and, under the action of buoyancy, begins to move upward. The liquid displaced during the movement of the platform (3) flows through the windows (8) and further along the channel (4) from the upper part of the body (1) to the lower one, while rotating the turbine (2) blades, which, in turn, makes the generator produce electric power that is transmitted to the consumer or for storage using the means for transmitting the generated electric power (not shown in the FIGURE). When the platform (3) reaches the upper position, the valves (9) are opened to release air from the means (5) for imparting buoyancy to the platform. Air, passing through the channel (4), enters the blades of the turbine (2) designed so as to be able to rotate both under the action of water and under the action of air, makes the turbine (2) rotate, which, in turn, causes the generator to produce electric power that is transmitted to the consumer or for storage using the means for transmitting the generated electric power (not shown in the FIGURE). After the air is released from the means (5), the platform (3) acquires negative buoyancy and lowers under the action of gravity. The liquid displaced during the downward movement of the platform flows through the channel (4) and windows (8) from the lower part of the boy (1) to the upper one, while rotating the turbine (2) blades, which, in turn, causes the generator to produce electric power that is transmitted to the consumer or for storage using the means for transmitting the generated electric power (not shown in the FIGURE).

The presented FIGURE, description of the structure and use of the generator do not exhaust the possible embodiments and do not in any way limit the scope of the claimed technical solution. Other options for the implementation and use are possible within the scope of the claim. Depending on the purpose, the generator can be manufactured in different sizes and configurations.

The power generator is characterized by high performance efficiency due to additional generation of electric power when the turbine rotates under the action of air released from the means for imparting buoyancy to the platform.

The invention claimed is:

1. A power generator containing a body in the form of a vertical vessel filled with liquid, in which a platform with an opening in the upper part, the inner part of which has the shape of a bell, is placed, as well as a means to impart positive buoyancy to the platform by accumulating air, located on the lower side of the platform, a channel connected to the opening in the upper part of the platform, windows connected to the channel, valves installed between the channel and the means for imparting positive buoyancy to the platform; a turbine installed on the platform, designed so as to be able to rotate under the action of liquid flowing through the channel, and equipped with means for transmitting the generated electric power; means for preventing the platform from rotating, characterized in that the turbine is designed so as to be able to rotate under the action of air released through the valves from the means for imparting positive buoyancy to the platform.

2. The power generator according to claim 1, characterized in that it contains additional valves installed in the windows connected to the channel.

3. The power generator according to claim 1, characterized in that the platform has a cross-sectional shape that follows the cross-sectional shape of the inner surface of the body.

4. The power generator according to claim 1, characterized in that the means for preventing the platform from rotating is made in the form of a protrusion on the platform, located in the corresponding recess on the inner surface of the body.

* * * * *